US005898447A

United States Patent [19]

Kitamura et al.

[11] Patent Number: 5,898,447

[45] Date of Patent: Apr. 27, 1999

[54] IMAGE FORMING APPARATUS

[75] Inventors: Tetsuya Kitamura, Gifu; Masaki Takatsugi, Seto, both of Japan

[73] Assignee: Brother Kogyo Kabushiki Kaisha, Nagoya, Japan

[21] Appl. No.: 08/434,341

[22] Filed: May 2, 1995

[30] Foreign Application Priority Data

Jul. 12, 1994 [JP] Japan ..... 6-159802

[51] Int. Cl.[6] ..... B41J 2/06

[52] U.S. Cl. ..... 347/55

[58] Field of Search ..... 347/55, 151, 141, 347/112, 147; 430/102, 103

[56] References Cited

U.S. PATENT DOCUMENTS

| | | | |
|---|---|---|---|
| 3,672,884 | 6/1972 | Mayer | 430/102 |
| 3,689,935 | 9/1972 | Pressman et al. | 347/55 |
| 5,036,341 | 7/1991 | Larsson | 347/55 |
| 5,497,175 | 3/1996 | Maeda et al. | 347/55 |
| 5,558,969 | 9/1996 | Uyttendaele et al. | 347/55 X |

FOREIGN PATENT DOCUMENTS 0 587 366 A1 3/1994 European Pat. Off. .

OTHER PUBLICATIONS

Patent Abstracts of Japan, vol. 15, No. 237 (P1216) Jun. 19, 1991.

Patent Abstracts of Japan, vol. 7, No. 2281 (P127) Oct. 8, 1993.

Patent Abstracts of Japan, vol. 11, No. 45 (P–546), Feb. 10, 1987, JP–61–A–213831, (Hitachi Maxell LTD).

*Primary Examiner*—Benjamin R. Fuller
*Assistant Examiner*—C. Dickens
*Attorney, Agent, or Firm*—Oliff & Berridge, PLC

[57] ABSTRACT

An aperture electrode member includes an insulating sheet having a plurality of apertures formed in a row therein, and a control electrode formed on the insulating sheet on the upper side of each of the apertures. On the face of the insulating sheet opposite to the face on which the apertures are formed, a coating layer serving as an oxide fine particle layer is formed at portions of insulating sheet at which the insulating sheet contacts with toner particle carried on the toner carrying roller. A coating layer can be formed by dispersing carbon serving as an antistatic agent and oxide fine particle silica serving as a fluidity increasing agent into a binder, applying the mixture to the insulating sheet to form a film and baking to harden it.

20 Claims, 4 Drawing Sheets

IMAGE FORMING APPARATUS

BACKGROUND OF THE INVENTION

1. Field of the Invention

This invention relates to an image forming apparatus for use with copying machines, printers, plotters, facsimile apparatus and like apparatus.

2. Description of the Related Art

As one of conventional image forming apparatus, an image forming apparatus is disclosed in U.S. Pat. No. 3,689,935 wherein a voltage is applied to an electrode, which has a plurality of openings (hereinafter referred to as apertures) formed therein, in accordance with image data to control passage of toner particles through the apertures so that those toner particles passing through the apertures may form an image on a support member.

The image forming apparatus just described includes a flat plate made of an insulating material, a continuous reference electrode formed on one face of the flat plate, and a plurality of control electrodes formed on the other face of the plate member in an isolated relationship from each other. The image forming apparatus further includes an aperture electrode member extending, for each of the control electrodes, through the flat plate, the reference electrode and the control electrode and having at least a row of apertures formed therein, means for selectively applying a potential between the reference electrode and the control electrodes, means for supplying charged toner particles so that flows of toner particles to pass through the apertures may be modulated by the thus applied potential, and means for moving a support member and the aperture electrode member relative to each other to position the support member in the flow paths of the toner particles.

With this apparatus, however, the apertures are choked with toner particles to deteriorate the recording quality, and besides, the recording speed cannot be made very high.

The applicant of the present application has proceeded with further investigations and proposed an image recording apparatus disclosed in European Patent No. 587,366 (Japanese Patent Laid-Open Applications Nos. Hei 6-155798 and Hei 6-79907) wherein a carrying member which carries toner particle thereon and an aperture electrode member are disposed in a mutually contacting relationship with each other, thereby improving the recording characteristic remarkably. With the apparatus, since toner particle is supplied in contact with the aperture electrode member around apertures of the aperture electrode member, toner particle which causes choking of the apertures is not deposited in the apertures, and consequently, the apertures are not choked.

With the conventional image forming apparatus, however, when toner particles on the aperture electrode member and the toner carrying member slidably moves in contact with them, it is pressed against the aperture electrode member, and consequently, transportation of the toner particle is sometimes retarded on contacting faces of the aperture electrode member and the toner carrying member. When toner particle is contacted with the aperture electrode member, the contacting portion of the aperture electrode member is charged and toner particle is caused to stay there. If toner particle stays, then succeeding toner particle is not transported regularly to the downstream side of the thus staying toner particle in the direction of transportation of toner particle. Consequently, the toner particle transportation condition is rendered unstable and toner particle may not be supplied uniformly to the apertures. As a result, the problem that a large amount of toner particle is transported into one of the apertures while no toner particle is transported into another of the apertures at all arises, resulting in irregularity in an output image in the direction of the arrangement of the apertures, which makes the output image unattractive and of poor quality.

SUMMARY OF THE INVENTION

It is an object of the present invention to provide an inexpensive image forming apparatus which can form an image of a high quality free from irregularities.

In order to attain the object described above, according to the present invention, there is provided an image forming apparatus comprising toner flow control means including a toner flow control section having a plurality of apertures, a toner carrying member, or toner carrier, contactable at least with the toner flow control section of the toner flow control means and supplying charged toner particles to the apertures, a back electrode located remotely from the toner carrying member with respect to the toner flow control means, and an oxide fine particle layer provided at least at a portion of the toner flow control means that contacts the toner carrier, the layer having oxide fine particles mixed therein.

Preferably, the oxide fine particles are silicon oxide.

The oxide fine particle layer may be formed of an antistatic agent and the oxide fine particles. Preferably, the antistatic agent is carbon.

In the image forming apparatus of the present invention having the construction described above, toner particle is carried on the toner carrying member and transported to the toner flow control section of the toner flow control means. In this instance, the oxide fine particle layer is provided at least at the portion of the toner flow control means that contacts the toner carrier. The oxide fine particles have a function as a fluidity providing agent to toner particles and prevent toner particles from sticking or staying at the toner flow control section. Consequently, toner particle is supplied uniformly to the apertures, and an image of a high quality free from irregularity can be formed.

Since the oxide fine particles project from the toner sticking face of the oxide particle layer, a gap is produced between the toner particles and the toner sticking face of the oxide fine particle layer. Consequently, the Van der Waals force acting upon the toner particles is decreased remarkably, which makes it less liable for the toner particles to stay on the toner sticking face. This is because the Van der Waals force is a force acting between molecules and varies inversely to the square of the distance between molecules.

Where the oxide fine particle layer is formed of the oxide fine particles and an antistatic agent, charging of the toner flow control section by contact with toner particles is prevented, and consequently, the fluidity of the toner particle is further increased. Sticking or staying of toner particle can sometimes occurs due to an electrostatic force by charging and the Van der Waals force, but sticking or staying of toner particles is further prevented by the layer constituted of the antistatic agent and the oxide fine particles.

Here, the oxide fine particles may be selected, as a fluidity providing agent, among silicon oxide, alumina, titanium oxide and so forth. Particularly, silicon oxide is suitable since it is readily available and many kinds of silicon oxides are available. Meanwhile, the antistatic agent may be selected, as conductive fine particles, among aluminum, molybdenum, nickel, chrome, carbon and so forth.

Particularly, carbon, for example carbon black, is suitable since it is easy to produce (only combustion is required) and is inexpensive.

As apparent from the foregoing description, in the image forming apparatus of the present invention, the fluidity increasing function of the oxide fine particle layer prevents toner particles transported to the aperture electrode member by the toner carrying roller from sticking to and staying on the toner contacting face of the aperture electrode member on the contacting faces of the toner carrying roller and the aperture electrode member, and consequently, the toner particle moves smoothly. As a result, the amount of toner particles to be transported to the apertures is made constant, and consequently, an image free from irregularities can be obtained.

BRIEF DESCRIPTION OF THE DRAWINGS

A preferred embodiment of the present invention will be described in detail with reference to the following figures, wherein.

DETAILED DESCRIPTION OF THE PREFERRED EMBODIMENT

In the following, a preferred embodiment of the present invention will be described with reference to the drawings.

Figure 1:
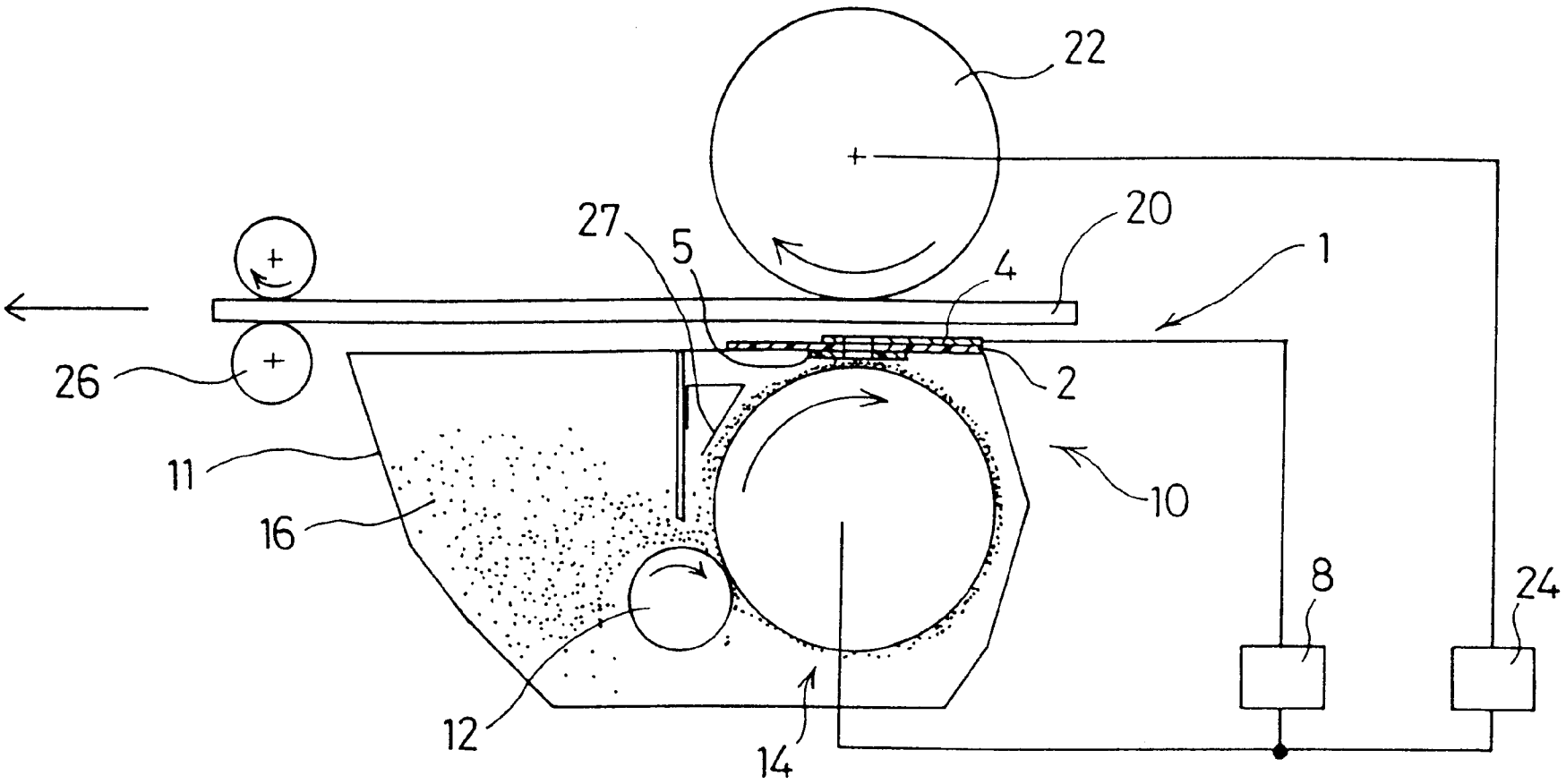
FIG. 1 is a sectional view showing an embodiment wherein the construction of an image forming apparatus of the present invention is embodied.

FIG. 1 is a view showing an outline of an image forming apparatus of the present embodiment. Referring to FIG. 1, a cylindrical back electrode roller 22 serving as a back electrode is supported for rotation on a chassis (not shown) above an aperture electrode member 1 serving as toner flow control means with a gap of preferably about 1 mm left therebetween. The back electrode roller 22 is driven to rotate in the clockwise direction in FIG. 1 by a transport motor.

A follower roller (not shown) serving as biasing means is disposed for rotation at locations outwardly of the opposite end portions of the aperture electrode member 1 in its longitudinal direction (aperture arrangement direction). The follower roller is normally biased by a spring serving as a resilient member toward the back electrode roller 22. When an image forming medium (paper sheet, OHP (overhead projection) sheet or the like) 20 serving as a support member is inserted into the gap, it is held by the back electrode roller 22 and the follower roller and is transported, by energization of the transport motor, leftwardly in FIG. 1 while keeping a predetermined gap from the aperture electrode member 1. It is to be noted that the follower roller biases the image forming medium 20 toward the back electrode roller 22 to allow the image forming medium 20 to be transported by rotation of the back electrode roller 22. In other words, the follower roller serves as means for biasing the image forming medium 20 toward the back electrode roller 22. The biasing means may alternatively be a blasting apparatus for blasting an air flow to the image forming medium 20.

Meanwhile, a toner supply apparatus 10 is disposed along the longitudinal direction of the aperture electrode member 1 below the aperture electrode member 1. Further, a fixing apparatus 26 for heating toner particle into a molten condition to fix the toner to the image forming medium 20 is disposed at a location to which the image forming medium (support member) 20 is transported by the back electrode roller 22.

Subsequently, details of the above components will be described. The toner supply apparatus 10 includes a toner case 11 which also serves as a housing for the entire apparatus, toner particle 16 accommodated in the toner case 11, a supply roller 12, a toner carrying roller 14, and a toner layer controlling blade 27. Here, the toner carrier, shown as a roller, 14 carries and transports the toner particles 16 thereon toward the aperture electrode member 1. The supply roller 12 supplies the toner particle 16 to the toner carrying roller 14.

The supply roller 12 and the toner carrying roller 14 are supported for rotation in the directions indicated by individual arrow marks in FIG. 1 on the toner case 11 and are disposed in parallel to each other in a mutually contacting condition. The supply roller 12 and the toner carrying roller 14 are rotated in an interlocking relationship with each other by a driving motor. Meanwhile, the toner layer controlling blade 27 is provided to adjust the amount of toner particle 16 carried on the toner carrying roller 14 so that the toner particle 16 may be leveled on the surface of the toner carrying roller 14 and also to charge the toner particle 16 uniformly. The toner layer controlling blade 27 is held in contact with the toner carrying roller 14.

Figure 2:
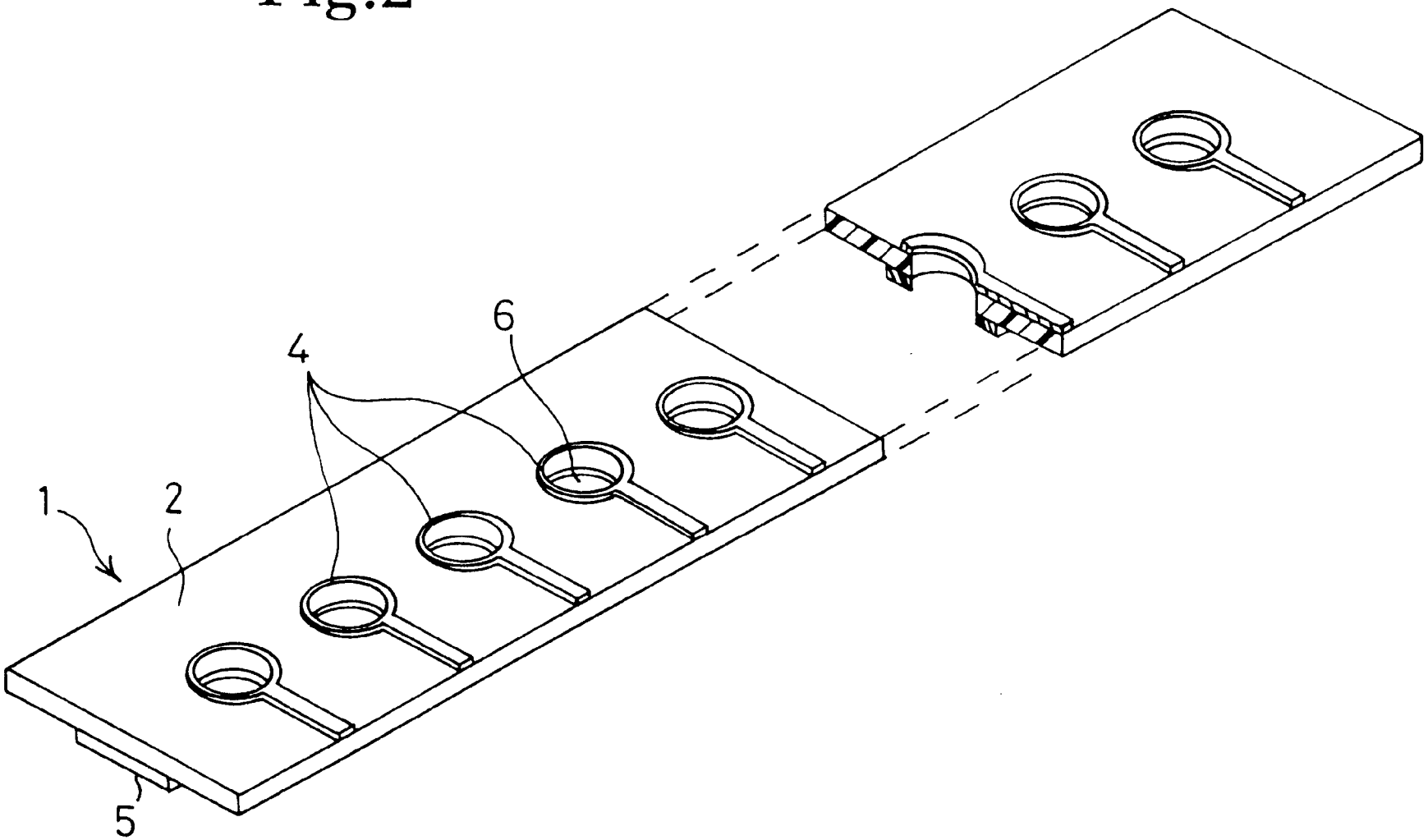
FIG. 2 is a perspective view of an aperture electrode member employed in the image forming apparatus shown in FIG. 1.
Figure 3:
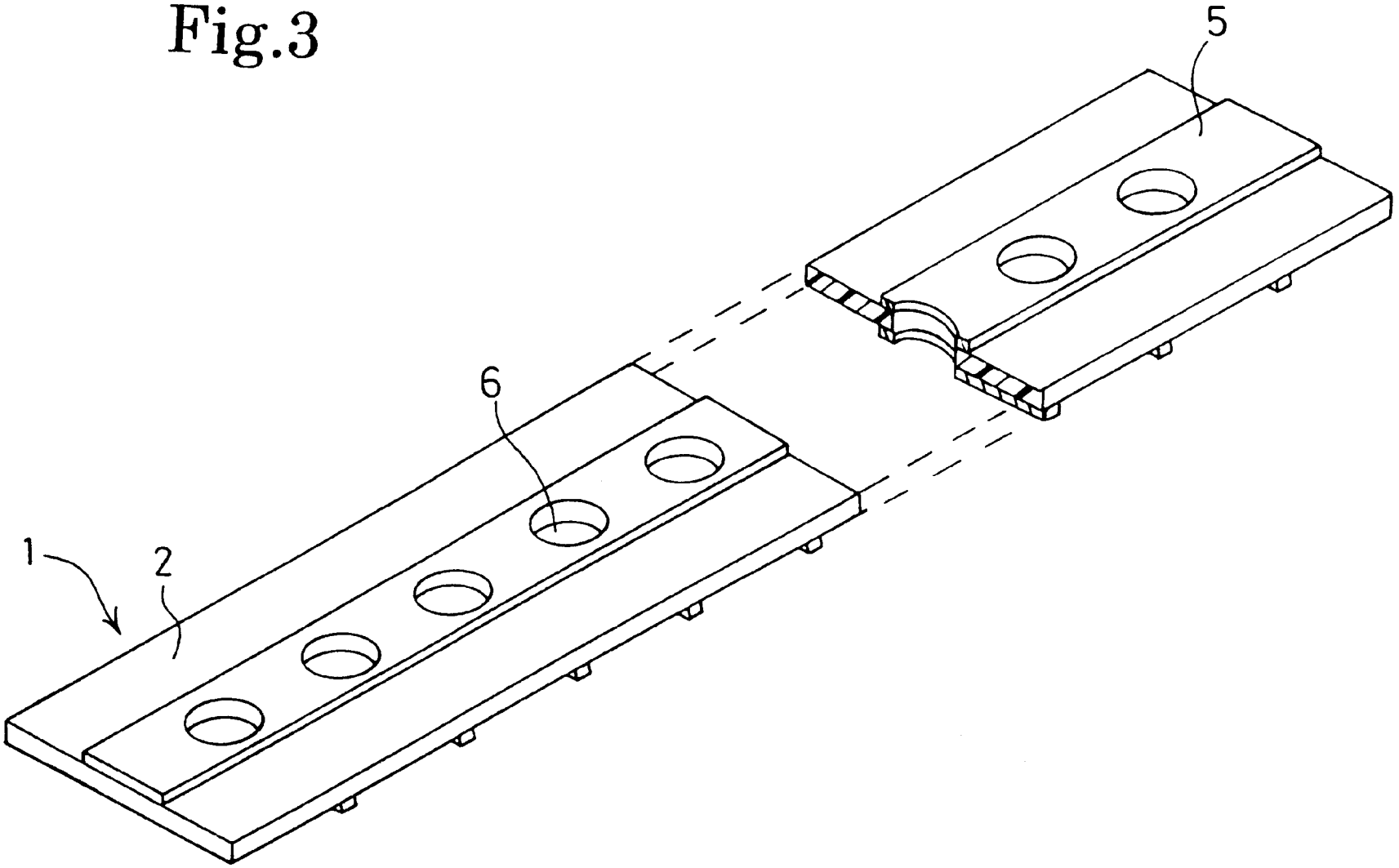
FIG. 3 is a perspective view of the aperture electrode member of FIG. 2 employed in the image forming apparatus of FIG. 1 as viewed from the back.

Referring to FIG. 2, the aperture electrode member 1 includes an insulating sheet, for example preferably of about 2 to 25 $\mu$m thickness, and preferably made of polyimide, although any known suitable insulating binder materials, such as resins, may be used, and having a plurality of apertures, for example preferably of about 6 to 80 $\mu$m in diameter, formed in a row therein, and a control electrode 4, for example preferably of about 8 $\mu$m thick, formed on the insulating sheet 2 on the upper side of each of the apertures 6. On the face of the insulating sheet 2 opposite to the face on which the apertures 6 are formed, a coating layer 5, for example preferably of about 5 $\mu$m thick, serving as an oxide fine particle layer is formed on the opposite sides of the apertures 6 in the direction of transportation of toner particle, that is, at portions of insulating sheet 2 at which the insulating sheet 2 contacts with the toner particles 16 carried on the toner carrying roller 14.

The coating layer 5 is a film formed by dispersing carbon serving as an antistatic agent and oxide fine particle such as silica (silicon oxide) serving as a fluidity increasing agent into a binder made of an organic resin such as an epoxy resin or a polyimide resin, preferably a polyimide resin, to obtain a paint-like mixture, applying the mixture to the insulating sheet 2 to form a film and baking it in an atmosphere lower than 300° C., preferably in an atmosphere of 200° C. to 280° C., to harden it. As the antistatic agent, conductive fine particles of aluminum, nickel, chromium, carbon or the like are used. Here, carbon, for example, carbon black, is preferred because it is inexpensive. Further, as oxide fine particles, a fluidity providing agent of silicon oxide, alumina, titanium oxide, zinc oxide, magnesium oxide or the like are used. Here, silicon oxide is preferred because it is readily available.

The aperture electrode member 1 is disposed such that the control electrodes 4 are opposed to the image forming medium (support member) 20 as shown in FIG. 1 and the coating layer 5 on the insulating sheet 2 is contacted with the toner particle 16 on the toner carrying roller 14 at the location of the apertures of the face of the insulating sheet 2 on which the coating layer 5 is formed.

A control voltage application circuit 8 is connected between the control electrodes 4 and the toner carrying roller 14. The control voltage application circuit 8 receives an image signal expanded in a dot pattern from the outside, and controls on/off operations (application of the voltage of −20 V or application of the voltage of +20 V) of the individual control electrodes 4 in response to on/off states of individual dots of a dot string. The control voltage application circuit 8 performs such control in association with rotation of the back electrode roller 22. In short, after flying control of toner particle for one dot string is completed by the back electrode roller 22, flying control of toner particle for a next dot string is performed.

Furthermore, a DC power source 24 is connected between the back electrode roller 22 and the toner carrying roller 14. The DC power source 24 is provided to apply a voltage of +1 kV to the back electrode roller 22.

Subsequently, operation of the image forming apparatus constructed in such a manner as described above will be described.

First, an outline will be described. When the toner carrying roller 14 and the supply roller 12 are rotated in the directions indicated by the individual arrow marks in FIG. 1, the toner particle 16 supplied from the supply roller 12 is rubbed against the toner carrying roller 14 so that it is charged to the negative and transferred to the toner carrying roller 14. The toner particle 16 carried on the toner carrying roller 14 is then leveled into a thin film and charged by the toner layer controlling blade 27 and then transported toward the aperture electrode member 1 by rotation of the toner carrying roller 14. Then, the toner particle 16 on the toner carrying roller 14 is supplied to the location below the apertures 6 while being rubbed against the coating layer (oxide fine particle mixing portion of the present invention) 5 of the aperture electrode member 1.

Here, in response to an image signal, a voltage of +20 V is applied from the control voltage application circuit 8 to those of the control electrodes 4 which correspond to an image of the image signal (on-state dots of the dot string). As a result, around the apertures 6 which correspond to the image signal, electric lines of force are formed from the control electrodes 4 to the toner carrying roller 14 due to a potential difference between the control electrodes 4 and the toner carrying roller 14. Consequently, the toner particle 16 charged to the negative is acted upon by an electrostatic force toward a higher potential side and is thus attracted from the toner carrying roller 14 toward the control electrodes 4 passing through the apertures 6. The thus drawn out toner particle 16 is flown toward the support member 20 by an electric field formed between the support member 20 and the aperture electrode member 1 by the voltage applied to the back electrode plate roller 22 and is deposited on the support member 20 to form picture elements.

Meanwhile, a voltage of −20 V is applied from the control voltage application circuit 8 to those of the control electrodes 4 which do not correspond to the image signal (off-state dots of the dot train). As a result, electric lines of force directed to the control electrodes 4 are formed between the toner carrying roller 14 and the control electrodes 4. Then, since the toner particle 16 charged to the negative is not acted upon by an electrostatic force toward a higher potential side, the toner particle 16 on the toner carrying roller 14 does not pass through the corresponding apertures 6. In other words, the toner particle does not fly.

Further, while a row of picture elements is formed on the surface of the support member 20 with the toner particle 16, the support member 20 is transported by a distance corresponding to one picture element in a direction perpendicular to the row of apertures. Then, as the process described above is repeated, a toner particle image is formed on the entire surface of the support member 20. Thereafter, the toner powder image thus formed is heated to be fixed to the support member 20 by the fixing apparatus 26.

Subsequently, the image forming process will be described in detail. The present process is characterized in that, since the toner particles on the toner carrying roller 14 are supplied in a reduced sticking force to the apertures as the coating layer 5 provided on the aperture electrode member 1 and the toner particles carried on the toner carrying roller 14 are contacted with each other, the toner particle flows can be controlled at a low voltage. In particular, since the aperture electrode member 1 and the toner particles carried on the toner carrying roller 14 are contacted with each other by way of the coating layer 5 (the toner particle is contacted with the aperture electrode member 1 in the proximity of the apertures), the toner particle is rolled on the toner carrying roller 14. Consequently, the toner particle can be controlled (discharged from the toner carrying roller 14 by an electromagnetic force) readily at a control voltage lower than the voltage required when they are in a stationary condition.

In a conventional image forming apparatus, since no coating layer is provided on the aperture electrode member, toner particles are contacted with the aperture electrode member, whereupon the rear face (toner particle contacting face) of the aperture electrode member is charged. Consequently, toner particles are caused to stick to the rear face of the aperture electrode member and retard flows of the toner particle. Accordingly, the transportation condition of toner particle on the contacting faces of the aperture electrode and the toner carrying roller is very complicated and irregular. As a result, the problem that a large amount of toner particle is transported into one of the apertures while no toner particle is transported into another of the apertures at all arises, resulting in irregularity in an output image in the direction of the arrangement of the apertures, which makes the output image unattractive and of poor quality.

However, in the arrangement wherein toner particle is supplied to the location below the apertures 6 using the aperture electrode member 1 having the coating layer 5 of the present embodiment, the fluidity increasing function of oxide fine particles such as silica (silicon oxide) included in the coating layer 5 prevents toner particle transported to the aperture electrode member 1 by the toner carrying roller 14 from sticking to and staying on the toner contacting face of the aperture electrode member 1 on the contacting faces of the toner carrying roller 14 and the aperture electrode member 1, and consequently, the toner particle moves smoothly. Further, since the coating layer 5 is provided with a charge preventing function due to an antistatic agent such as carbon contained therein, it is not charged at all when it is contacted with and slidably moved on the toner carrying roller and the toner particles, and consequently, no unnecessary electrostatic force is applied to the toner being transported.

The oxide fine particle (e.g., silicon oxide) fluidity increasing function is based on the following action.

A Van der Waals force acts upon toner particles. This force is an attracting force component of an inter-molecular force and varies inversely as square to an inter-molecular distance. Generally, it is said that this force is dominant where the inter-molecular force is less than 0.01 μm. Here, the particle size of toner particle is approximately 10 μm, and the particle size of silicon oxide is approximately 0.1 μm. Since particles of silicon oxide project a little from the toner sticking face of the coating layer 5, the toner particles are spaced away by the projecting amount from the toner sticking face. Since the Van der Waals force varies inversely proportional to the square of the distance, as described above, the Van der Waals force is very low comparing with that of the case where no silicon oxide is mixed (comparing with that of the case where only carbon is involved), and consequently, sticking of the toner particle to the coating layer 5 is prevented. Further, since charging is prevented, sticking by an electrostatic force is also prevented. Consequently, toner particles that stay on the coating layer 5 of the aperture electrode member 1 are prevented.

Further, since silica (silicon oxide) contained in the coating layer 5 not only is provided with the fluidity increasing function described above but also is in the form of very hard particles, it has an effect as a reinforcing member for providing durability to the coating layer 5. Further, since the primary particle size of the silica is several tens nm, the silica can act also as a dispersion assisting agent for carbon and accordingly has an effect of improving the dispersion condition of carbon. Further, there is also such an effect that the charge preventing function is stabilized.

It is to be noted that the present invention is not limited to the embodiment described in detail above and many changes and modifications can be made thereto without departing from the spirit and scope of the invention as set forth herein.

Figure 4:
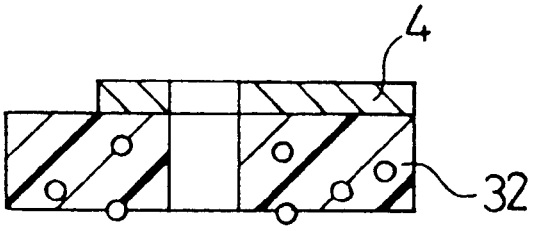
FIGS. 4(A) to 4(D) are sectional views showing different forms of the aperture electrode member which may be employed in the image forming apparatus shown in FIG. 1.
Figure 4:
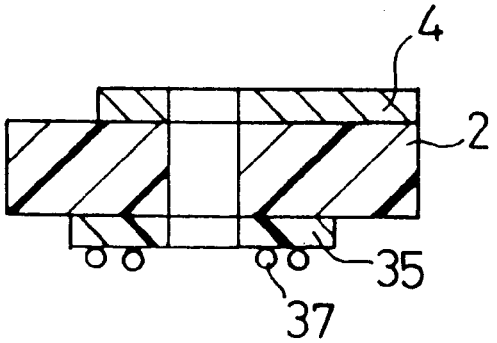
Figure 4:
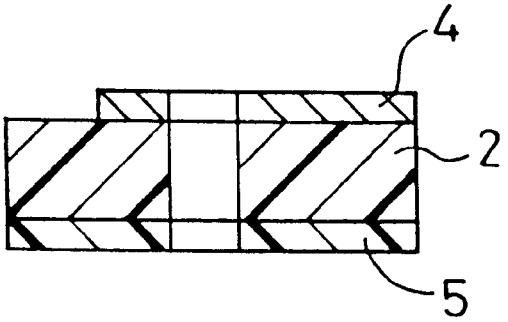
Figure 4:
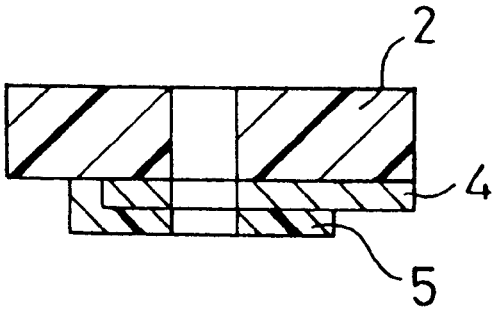

While, in the present embodiment, the oxide fine particle layer is in the form of a coating layer, it is also possible to use, as shown in FIG. 4(A), a resin sheet 32, preferably an insulating resin, to which silica and carbon are added. With the construction, the necessity for coating and for a separate insulating sheet is eliminated.

Further, it is also possible to incorporate, as shown in FIG. 4(B), oxide fine particles 37 onto a coating layer 35 to which only carbon is added so that a fluidity increasing effect may be exhibited. Since the particle size of oxide fine particles is several tens nm and very small, the oxide fine particles stick firmly to a coating layer containing carbon, for example, as an antistatic agent, by the Van der Waals force. Accordingly, the oxide fine particles will not be exfoliated by sliding movement with toner particle.

Or else, as shown in FIG. 4(C), the coating layer 5 may be provided on the entire rear face of the aperture electrode member 1.

Further, while, in the embodiment described above, the aperture electrode member 1 is disposed such that the control electrodes 4 thereof are opposed to the back electrode roller 22, it is also possible to dispose the aperture electrode member 1 such that the control electrodes 4 are opposed to the toner carrying roller 14. In this instance, the coating layer 5 may be provided at least at that portion of the face of the aperture electrode member 1, on which the control electrodes 4 are formed, which is contacted with the toner particle 16 carried on the toner carrying roller 14 as seen in FIG. 4(D).

While, in the embodiment described above, an aperture electrode member is used as the toner flow control means, it is also possible to use such an electrode member in the form of a net as disclosed, for example, in U.S. Pat. No. 5,036,341.

What is claimed is:

1. An image forming apparatus comprising:

a toner flow control section having a plurality of apertures;

a toner carrier contactable with said toner flow control section to supply charged toner particles to said plurality of apertures;

a back electrode located on a side of said toner flow control section opposite from said toner carrier; and an oxide fine particle layer provided on said toner flow control section at least at a portion of said section that contacts with said toner carrier, said layer containing oxide fine particles that project outwardly from a toner contacting face of said oxide fine particle layer and an antistatic agent.

2. The image forming apparatus according to claim 1, wherein said oxide fine particles are a fluidity providing agent and comprise at least one of silicon oxide, alumina, titanium oxide, zinc oxide and magnesium oxide.

3. The image forming apparatus according to claim 1, wherein said oxide fine particles are silicon oxide fine particles.

4. The image forming apparatus according to claim 1, wherein the oxide fine particle layer is adhered firmly in association with the toner flow control section so as not to be exfoliated by the charged toner particles contacting the layer.

5. The image forming apparatus according to claim 1, wherein said antistatic agent comprises conductive fine particles comprising at least one member selected from the group consisting of aluminum, molybdenum, nickel, chrome and carbon.

6. The image forming apparatus according to claim 1, wherein said antistatic agent is carbon.

7. The image forming apparatus according to claim 1, wherein said antistatic agent is carbon and said oxide fine particles are silicon oxide fine particles.

8. The image forming apparatus according to claim 1, wherein said toner flow control section comprises a control electrode, and said oxide fine particle layer is formed on a face of said toner flow control section opposite to a face on which said control electrode is formed.

9. The image forming apparatus according to claim 1, wherein said toner flow control section comprises a control electrode and said oxide fine particle layer is formed on a face of said toner flow control section on which said control electrode is formed.

10. The image forming apparatus according to claim 1, wherein said oxide fine particle layer has a thickness of about 5 μm.

11. The image forming apparatus according to claim 1, wherein said oxide fine particle layer is formed on a coating provided at least at a portion of said toner flow control section that contacts with said toner carrier.

12. An image forming apparatus comprising:

a toner flow control section having a plurality of apertures;

a toner carrier contactable with said toner flow control section to supply charged toner particles to said plurality of apertures; and a back electrode located on a side of said toner flow control section opposite from said toner carrier;

wherein said toner flow control section includes an insulating layer serving as a base plate and containing a fluidity providing agent comprised of oxide fine particles and an antistatic agent.

13. The image forming apparatus according to claim 12, wherein said fluidity providing agent is silicon oxide fine particles, and said antistatic agent is carbon.

14. An aperture electrode member for use in an image forming apparatus, comprising a plurality of apertures in an insulating layer, a control electrode, and a layer containing oxide fine particles that project outwardly from a toner contacting face of said layer and an antistatic agent.

15. An aperture electrode member according to claim 14, wherein said layer containing oxide fine particles is coated on a face of said insulating layer opposite a face to which said control electrode is provided.

16. An aperture electrode member according to claim 14, wherein said oxide fine particles are silicon oxide fine particles and said antistatic agent is carbon.

17. An aperture electrode member according to claim 14, wherein said layer containing oxide fine particles is adhered to a coating containing an antistatic agent.

18. An aperture electrode member according to claim 14, wherein said layer containing oxide fine particles is said insulating layer.

19. An aperture electrode member according to claim 14, wherein said layer containing oxide fine particles is provided on said control electrode.

20. An aperture electrode member according to claim 14, wherein the layer containing oxide fine particles is adhered firmly in association with the insulating layer or the control electrode so as not to be exfoliated by charged toner particles contacting the layer.

* * * * *